US005492208A

United States Patent [19]

Goossens

[11] Patent Number: 5,492,208

[45] Date of Patent: Feb. 20, 1996

[54] INTUMESCENT SECURITY PIN FOR FIRE RATED DOORS

[75] Inventor: Philip A. Goossens, Memphis, Tenn.

[73] Assignee: Pemko Manufacturing Company, Ventura, Calif.

[21] Appl. No.: 190,783

[22] Filed: Feb. 1, 1994

[51] Int. Cl.[6] ..... B05C 19/00

[52] U.S. Cl. ..... 292/2; 292/66

[58] Field of Search ..... 292/2, DIG. 17, 292/DIG. 65, DIG. 66; 49/475.1, 504, 383, 467; 52/309.4, 232

[56] References Cited

U.S. PATENT DOCUMENTS

| | | | |
|---|---|---|---|
| 3,636,659 | 1/1971 | Bylicki | 292/DIG. 17 X |
| 3,659,382 | 5/1971 | Dixon . | |
| 4,045,930 | 9/1977 | Dixon . | |
| 4,092,394 | 5/1978 | Dixon . | |
| 4,122,632 | 10/1978 | Dixon . | |
| 4,144,688 | 3/1979 | Dixon . | |
| 4,246,304 | 1/1981 | Dixon . | |
| 4,354,304 | 10/1982 | Dixon . | |
| 4,931,339 | 6/1990 | Malcolm-Brown . | |
| 5,121,950 | 6/1992 | Davidian | 292/DIG. 65 |
| 5,380,053 | 1/1995 | Saino | 292/DIG. 66 X |
| 5,427,420 | 6/1995 | Moore | 292/DIG. 66 X |

FOREIGN PATENT DOCUMENTS

| | | |
|---|---|---|
| 1067923 | 12/1979 | Canada . |
| 0050517 | 4/1982 | European Pat. Off. . |
| 1580160 | 11/1980 | United Kingdom . |
| 2078287 | 1/1982 | United Kingdom . |
| 2105394 | 3/1983 | United Kingdom . |
| 2104578 | 3/1983 | United Kingdom . |
| 2107183 | 4/1983 | United Kingdom . |
| 2123068 | 1/1984 | United Kingdom . |
| 2126891 | 4/1984 | United Kingdom . |
| 2213184 | 8/1989 | United Kingdom . |

OTHER PUBLICATIONS

Patent search report dated Sep. 8, 1993.
Patent search report dated Sep. 15, 1993.
Product brochure entitled "Sealmaster® Intumescent Fire & Smoke Protection", Feb. 1988.

*Primary Examiner*—Steven N. Meyers
*Assistant Examiner*—Monica E. Millner
*Attorney, Agent, or Firm*—Loeb and Loeb

[57] ABSTRACT

In a door assembly composed of a door frame, a door having a hinge side and a hinge supporting the door on the frame for pivotal movement of the door between an open position and a closed position, the hinge side of the door facing, and being adjacent to, a portion of the frame when the door is in the closed position, the door is provided with a recess in the hinge side; and the assembly is further provided with at least one projecting element secured to the frame portion to project into the recess when the door is in the closed position and having a mass of thermally intumescent material which is expandable for securing the projecting element to the door upon being heated above a predetermined temperature.

14 Claims, 2 Drawing Sheets

INTUMESCENT SECURITY PIN FOR FIRE RATED DOORS

BACKGROUND OF THE INVENTION

The present invention relates to doors which are to be prevented from opening in the event of a fire.

Many types of building structures have doorways whose doors are to be maintained permanently closed in the event of a fire, either to comply with local fire codes or, even if not required by fire codes, for safety reasons. It is desired to provide this capability, for example, for doors which are supported by aluminum geared hinges, which may be continuous hinges. It is recognized that it would be desirable to provide this capability with inexpensive, easily installed components which are unobtrusive. There may also be situations where it is desirable to achieve fire ratings by retrofitting existing doors in a simple and inexpensive manner.

In order for a door to be fire rated, it must be equipped with components which will completely prevent the door from being opened, other than by destroying it, when the door is heated to above a predetermined temperature characteristic of the temperature existing when a fire occurs.

It is already known in the art to employ thermally intumescent materials for sealing doors in a closed position in response to the heat generated by a fire. However, in known installations, application of the intumescent sealing materials is difficult and time consuming.

SUMMARY OF THE INVENTION

It is an object of the present invention to equip a door with simple and inexpensive components which are responsive, when the door is initially closed, to the heat generated by a fire so as to prevent the door from being opened.

Another object of the invention is to provide components which will prevent a door from being opened in the event of fire and which can be installed quickly and easily and can be retrofitted to existing doors.

The above and other objects are achieved, according to the present invention, in a door assembly composed of a door frame, a door having a hinge side and a hinge supporting the door on the frame for pivotal movement of the door between an open position and a closed position, the hinge side of the door facing, and being adjacent to, a portion of the frame when the door is in the closed position, by providing the door is with a recess in the hinge side; and providing at least one projecting element secured to the frame portion to project into the recess when the door is in the closed position and having a mass of thermally intumescent material which is expandable for securing the projecting element to the door upon being heated above a predetermined temperature.

DESCRIPTION OF THE PREFERRED EMBODIMENTS

Figure 1:
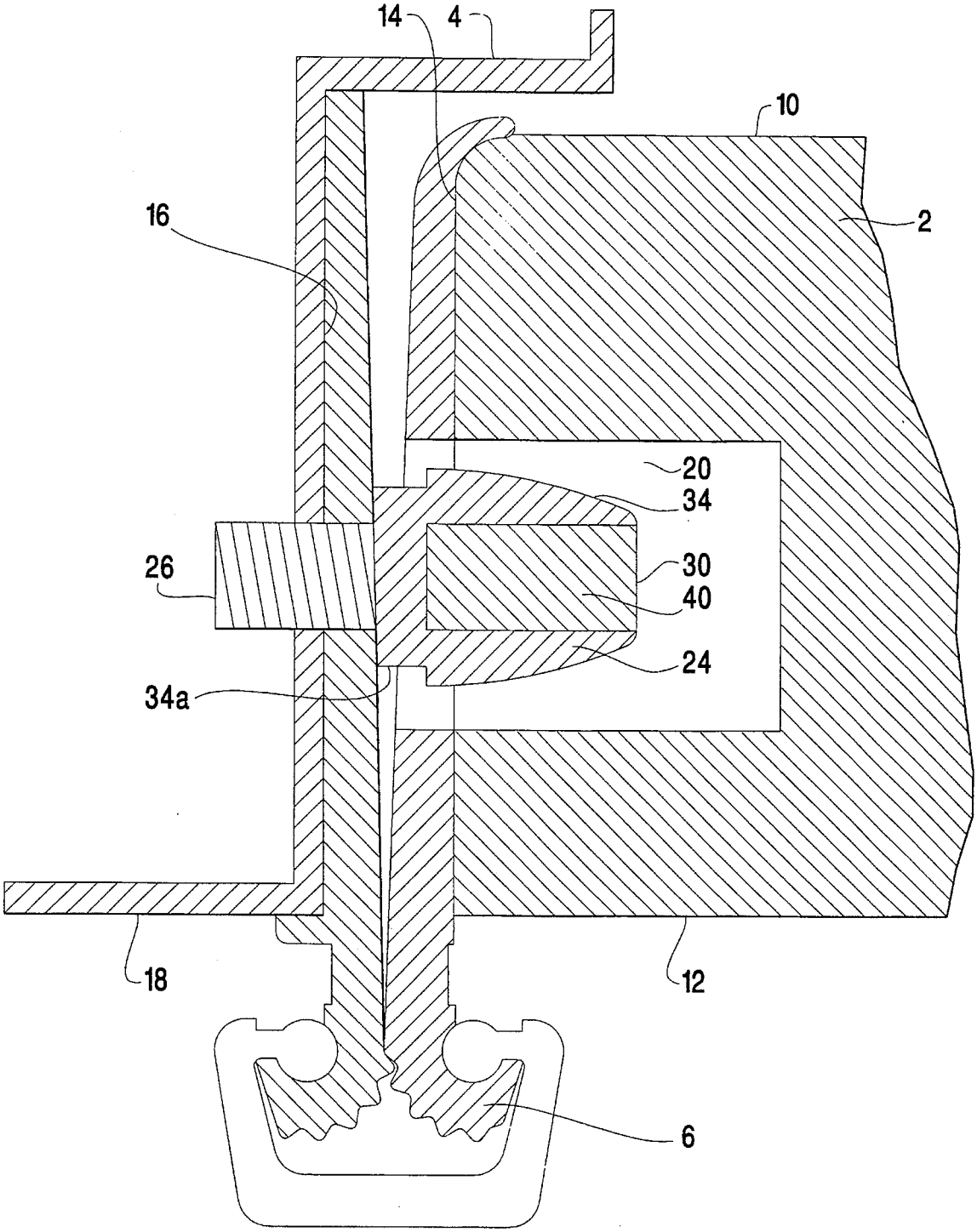
FIG. 1 is a cross-sectional view, taken in a horizontal plane, of a portion of a closed door equipped with a blocking element according to the invention.

FIG. 1 is a cross-sectional view, in a horizontal plane, showing a portion of a wood door 2 which is mounted to a hollow metal frame 4 via a continuous aluminum geared hinge 6. Hinge 6 is of a type known per se.

Door 2 has major exterior surfaces 10 and 12 and a vertically extending hinge side, or edge, 14 which faces a vertical portion 16 of frame 4 when door 2 is closed.

In the illustrated embodiment, the two halves of hinge 6 are interposed between hinge side 14 and vertical portion 16. However, other hinge styles may be used, such as one in which the hinge halves extend only partially across the thickness of door 2 or are flush mounted on door surface 12 and a second frame portion 18 that is flush with door surface 12.

According to the invention, door 2 is provided with at least one recess 20, which may be in the form of a blind bore of circular cross section, opening at hinge side 14. In the illustrated embodiment, the hinge half connected to hinge side 14 of door 2 is provided with a through hole coinciding with the outline of recess 20 at hinge side 14. Preferably, a plurality of such recesses 20 are provided, three such recesses being appropriate for a door having the standard height of 7 feet (2.13 m).

Each recess 20 is dimensioned to receive a respective pin 24 having a threaded shank 26 which mates with a threaded opening in frame portion 16, and in the associated hinge half in the illustrated embodiment, so as to be permanently attached thereto.

Pin 24 has a longitudinal axis which is oriented perpendicular to frame portion 16 and is provided, along the longitudinal axis, with a bore which extends over substantially the entire length of pin 24 and opens at the free end 30 thereof. Pin 24 has a longitudinal outer surface 34 extending between frame portion 16 and the free end 30 of pin 24.

Longitudinal outer surface 34 has a portion **34*a* of polygonal, e.g. square or hexagonal, cross section, in a plane perpendicular to the longitudinal axis of pin 24, for engagement with a tool employed to screw shank 26 into the threaded opening in frame portion 16. Otherwise, outer surface 34** may have a circular cross section.

The longitudinal bore is filled with a mass 40 of thermally intumescent material which will permanently expand by a substantial amount when heated to a temperature which occurs when a fire exists adjacent door 2.

The intumescent material forming mass 40 may be of a known type, such as a graphite-based or monoammonium phosphate-based material. Intumescent materials of this type are already known in the art and are available in the form of a moldable paste. Suitable materials of this type are marketed, for example, by Sealmaster, Ltd of Pampisford, Cambridge, England. Materials of this type are known to expand by a ratio of the order of 30:1 when heated to temperatures above 300° F.

Pin 24 is preferably dimensioned to occupy a major portion of recess 20 prior to expansion of mass 40 of thermally intumescent material. By way of nonlimiting example, pin 24 may have an outer diameter of the order of 0.65 to 0.80 times the outer diameter of recess 20 and a length of the order of 0.75 to 0.85 times the depth of recess 20. To cite a more specific example, if door 2 has a thickness of 1½" (3.8 cm), it would be desirable that each recess 20 be a circular bore having a diameter of not greater than ¾" (1.86 cm)so that a sufficient thickness of door material is present on each side of each recess 20. In this case, pin 24 would have a maximum diameter of between ½" (1.25 cm) and 9/16" (1.42 cm). Typically, pin 24 may have a length, along its longitudinal axis, of the order of ⅝" (1.59 cm), in which case the depth of the associated recess 20 would exceed the length of pin 24 by approximately ⅛" (0.32 cm) to ¼" (0.64 cm). In a pin 24 having these dimensions, the longitudinal bore in pin 24 could have a diameter of ¼" (0.64 cm) and the lateral bores would have diameters of the order of ⅛" (0.32 cm).

It will be seen that the longitudinal outer surface of pin 24 curves inwardly in the direction of free end 30 so that when mass 40 has not expanded, pin 24 will not interfere with opening movements of door 2. At the same time, a sufficiently small gap is maintained between the side wall of recess 20 and outer surface 34 of pin 24 in the vicinity of hinge side 14.

Pin 24 may be made, for example, of a suitable steel composition.

If a fire should occur in the building where door 2 is installed, mass 40 of intumescent material would begin to expand upon reaching a temperature of around 300° F. As the intumescent material expands, it fills recess 20 and then flows into any gap which is present between hinge side 14 and frame portion 16, or between the halves of hinge 6. Mass 40 may expand to such an extent as to wrap around portions of surfaces 10 and 12 adjacent hinge side 14. As a result, door 2 is sealed to pin, or pins, 24, thereby preventing opening of door 2.

In addition, when mass 40 expands in the manner described above, it creates a layer of thermal insulation between pin, or pins, 24 and door 2 so that as the temperature of pin, or pins, 24 increases, conduction of heat from pin, or pins, 24 to the core of door 2 is blocked.

As should be readily apparent from the preceding description, components for blocking a door in the closed position in the event of a fire can be installed easily and quickly. In the case of an existing door, installation can be accomplished easily and quickly without dismounting the door from its hinge or hinges.

Even if temperatures should be reached at which hinge 6 is melted, door 2 will remain blocked in its closed position.

Figure 2:
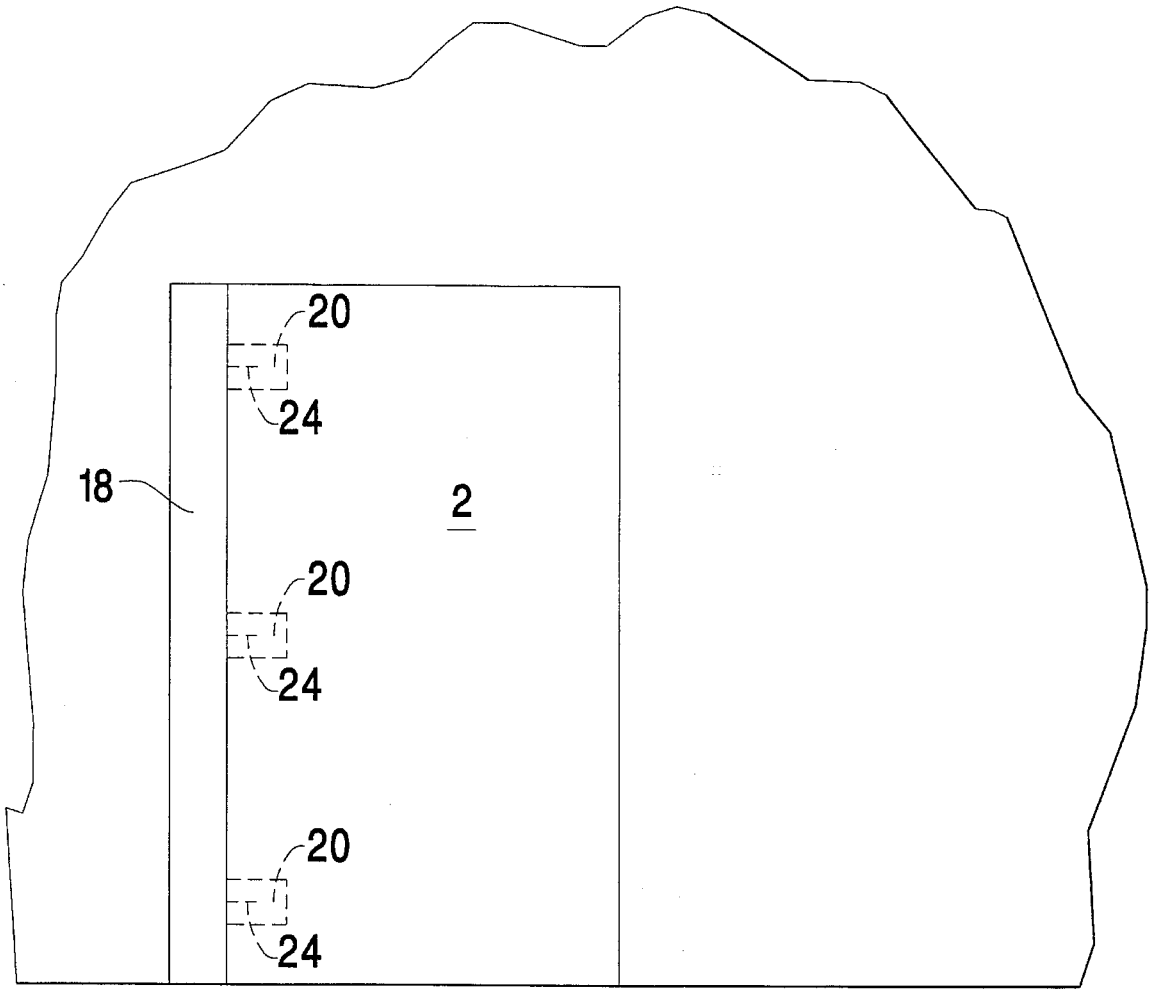
FIG. 2 is an elevational view of a door equipped with a plurality of the blocking elements of FIG. 1.

As noted earlier herein, in preferred embodiments of door assemblies according to the invention, the door is provided with a plurality of recesses 20, each receiving a respective pin 24. FIG. 2 is an elevational view showing an embodiment of a door assembly according to the present invention which is provided with three recesses 20 spaced apart at uniform intervals over the height of door 2, each recess receiving a respective pin 24. At each recess location, the structure provided is identical to that shown in FIG. 1. The threaded shank 26 (FIG. 1) of each pin 24 mates with a respective threaded opening in door frame portion 16 (FIG. 1). In FIG. 2, door frame portion 18 is visible.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In a door assembly composed of a door frame, a door having a hinge side and a hinge supporting the door on the frame for pivotal movement of the door between an open position and a closed position, the hinge side of the door facing, and being adjacent to, a portion of the frame when the door is in the closed position, the improvement wherein:

said door is provided with a recess in said hinge side; and said assembly further comprises at least one projecting element secured to said frame portion to project into said recess when said door is in the closed position, said projecting element comprising a metal pin having a longitudinal axis perpendicular to said frame portion, a free end remote from said frame portion and a bore extending along said longitudinal axis and opening at said free end, and a mass of thermally intumescent material which fills said bore and which is expandable for securing said projecting element to said door upon being heated above a predetermined temperature.

2. A door assembly as defined in claim 1, wherein said pin has a longitudinal outer surface that extends between said frame portion and said free end and that is curved to not interfere with opening of said door when said intumescent material has not expanded.

3. A door assembly as defined in claim 1, wherein said hinge is a continuous hinge extending over substantially the entire height of said door.

4. A door assembly as defined in claim 3, wherein said hinge is a geared aluminum hinge.

5. A door assembly as defined in claim 1, wherein said door is made of wood.

6. A door assembly as defined in claim 1, wherein said door has a plurality of recesses spaced vertically from one another in said hinge side, and there are a plurality of said projecting elements each secured to said frame portion to project into a respective recess.

7. A door assembly as defined in claim 1, wherein said recess is a circular recess having a diameter and said pin is a circular pin having a diameter of between about 0.65 and 0.80 times the diameter of said recess.

8. A door assembly as defined in claim 7, wherein said recess has a depth and said pin has a length, parallel to said longitudinal axis, of between about 0.75 and 0.85 times the depth of said recess.

9. A door assembly as defined in claim 7, wherein the difference between the depth of said recess and the length of said pin is between about ⅛" and about ¼".

10. A door assembly as defined in claim 7, wherein said recess is a circular recess with a diameter not greater than about ¾".

11. A door assembly as defined in claim 1, wherein said recess has a depth and said pin has a length, parallel to said longitudinal axis, of between about 0.75 and 0.85 times the depth of said recess.

12. A door assembly as defined in claim 11, wherein the difference between the depth of said recess and the length of said pin is between about ⅛" and about ¼".

13. A door assembly as defined in claim 1, wherein said recess is a circular recess with a diameter not greater than about ¾".

14. In a door assembly composed of a door frame, a door having a hinge side and a hinge supporting the door on the frame for pivotal movement of the door between an open position and a closed position, the hinge side of the door facing, and being adjacent to, a portion of the frame when the door is in the closed position, the improvement wherein:

said door is provided with a recess in said hinge side; and said assembly further comprises at least one projecting element secured to said frame portion to project into said recess when said door is in the closed position, said element comprising a mass of thermally intumescent material which is expandable for securing said projecting element to said door upon being heated above a predetermined temperature wherein said at least one projecting element is permanently fixed in a position in which said projecting element projects into said recess when said door is in the closed position.

* * * * *